US006831876B1

(12) United States Patent
Cartwright

(10) Patent No.: US 6,831,876 B1
(45) Date of Patent: Dec. 14, 2004

(54) ACOUSTIC WINDOW

(75) Inventor: Craig L. Cartwright, Jacksonville, FL (US)

(73) Assignee: Goodrich Corporation, Charlotte, NC (US)

( * ) Notice: Subject to any disclaimer, the term of this patent is extended or adjusted under 35 U.S.C. 154(b) by 0 days.

(21) Appl. No.: 10/616,179

(22) Filed: Jul. 9, 2003

(51) Int. Cl.[7] ..... G10K 11/00
(52) U.S. Cl. ..... 367/152; 367/191; 181/402
(58) Field of Search ..... 367/152, 174, 367/191; 181/402; 428/408, 415, 416

(56) References Cited

U.S. PATENT DOCUMENTS

| | | | | | |
|---|---|---|---|---|---|
| 2,960,175 | A | * | 11/1960 | McMillan | 181/402 |
| 3,858,165 | A | * | 12/1974 | Pegg | 367/173 |
| 4,770,267 | A | * | 9/1988 | Hauser | 367/191 |
| 4,784,898 | A | * | 11/1988 | Raghava | 442/253 |
| 4,997,705 | A | * | 3/1991 | Caprette et al. | 367/191 |
| 5,276,658 | A | * | 1/1994 | Bullat et al. | 367/174 |

FOREIGN PATENT DOCUMENTS

EP A-0274685 * 12/1987

* cited by examiner

*Primary Examiner*—Ian J. Lobo
(74) *Attorney, Agent, or Firm*—Goodrich Corporation

(57) ABSTRACT

An improved acoustic window for an acoustic waveform passage having a generally uniform transmission loss at an angle of incidence of between −40° and +40°. The composition is formed from at least one core layer and at least two septa, with the core layer being a material having a generally low-acoustic-impedance, a static shear modulus between about 1.0 psi (0.007 MPa) and about 15,000 psi (103 MPa), a transverse (or through-thickness) sound velocity for the acoustic waveform of between about 700 and about 2200 meters per second, a transverse acoustic impedance of less than or equal to $4\times10^6$ kilograms per square meter-second, and a shear loss factor of greater than 0.02, the septa being composed of at least one ply of a material, preferably a graphite fiber reinforced epoxy composition, having a transverse acoustic impedance of less than $60\times10^6$ kg/m$^2$-sec, a tensile modulus of more than $0.5\times10^6$ psi, a thickness of less than 0.10 $\lambda$, and each and being bonded to said core to form a sandwich with said core layer, and the window preferably has a thickness of less than 1.0 $\lambda_w$ and the acoustic waveform has a $\lambda$ of at least 0.001 meter and less than 3 meters.

47 Claims, 5 Drawing Sheets

FIG. 4: Typical Insertion Loss versus Angle of

ACOUSTIC WINDOW

BACKGROUND OF THE INVENTION

The present invention relates to windows for the passage of desired acoustic waveforms, and specifically to such windows employed in submerged liquid service such as underwater oceanic service. More particularly, the invention relates to sonar windows such as domes for use on surface and submergible vessels in both the military and commercial arenas.

Acoustic windows such as sonar domes for use in transmitting or receiving acoustic waveform signals in a liquid environment are well known in the art. Typically, these windows have consisted of a single thickness of a fiberglass composition optionally covered by a coating substance to minimize the fouling of surfaces of the window.

Typically, the exterior surface of such windows is exposed to a body of free liquid such as an ocean, lake or tank. The interior surface of such windows conventionally has at least partially defined a chamber filled with water or another liquid. In the prior art designs, it was important in submerged liquid applications to build windows to withstand a particular structural loading. Secondarily was a consideration to configure such windows to be acoustically "clear." That is, the window would have a desirably low distortion and attenuation of sound wave energy passing through the windows, as well as exhibiting a desirably low distortion of the angle characterizing the impingement of the wave energy against the window. However, the use of rigid high strength materials, in particular to meet structural loading requirements, has tended to make "tuning" sonar windows formed with such materials quite difficult. The properties of the materials of construction for the sonar windows, together with the structural loading imposed upon such windows, has tended to establish the acoustic properties of the window without much residual flexibility for tuning of the properties such as transmission loss and the like.

Windows such as sonar domes, depending of course on the particular application, can be required to transmit acoustic energy having a frequency ranging from about 10 Hz to about 1.5 MHz. These frequencies correspond to wavelengths of from about 150 meters to about 0.001 meters in water, respectively, with the wavelengths being subject to some variation depending upon the material through which the waveform is being propagated. However, many known prior art acoustic windows are limited to use in a certain frequency range due to the above-described structural and acoustical choices made in design of the windows.

Of course, it is understood that sonar domes are not the sole use for acoustically transparent materials. Frequently, it is desired that acoustic waveform energy be transmitted through a generally flush window or covered aperture in a vessel hull. The same constraints that limit use of conventional sonar domes to a certain frequency range also limits the use of such windows.

A number of efforts have been made to develop a sonar window, tunable to substantially reduce sound wave attenuation or distortion upon passage through the window, as well as sonar windows which reduce the reflective signals during passage of an acoustic waveform signal, by forming them from a plurality of materials. For example, U.S. Pat. No. 4,997,705 to Caprette, Jr. et al., teaches a laminate acoustic window for sonar systems having a pair of septa sandwiching a core, where the core is made of a low shear high elongation-to-break material and the septa are formed of a high modulus material. The windows of the invention are characterized by unusual freedom from attenuation loss over a wide, albeit generally low, frequency range. The windows are substantially self-damping and avoid thereby a generation of significant quantities of deleterious noise due to self-generated vibration and transmitted vibration. Caprette focuses on normal incidence angles, which is useful and broad since virtually all acoustic window applications include some normal incidence waveform transmission. In practice, however, most wave form transmissions occur at non-normal incidence angles, especially when the windows are curved. Caprette does not teach or suggest how to configure an acoustic window to achieve uniform (e.g. consistent within ±1 dB) transmission loss across a range of incidence angles and frequencies.

Other compositions include U.S. Pat. No. 4,770,267 to Hauser which teaches a sandwich construction where the central layer is a rigid core composed of glass fibers impregnated with resin and the peripheral layers are a plurality of woven webs of carbon fiber impregnated with thermosetting epoxy resin, but Hauser does not use or rely on the use of an elastomeric core material. U.S. Pat. No. 3,858,165 to Pegg teaches an acoustic window composition which is a laminate of layers of fiber glass cloth in an epoxy binder and which contains high strength glass microspheres or elastomeric polymer. U.S. Pat. No. 4,784,898 to Raghava teaches a composition of a layer of low loss sonar material, such as polyethylene and layers of fiberglass and epoxy.

SUMMARY OF THE INVENTION

The present invention is the result of the discovery that a composition acoustic window for an acoustic waveform passage having a generally uniform (less than about ±3 dB variation, preferably less than ±1 dB variation between +40° and −40° angles of incidence at a given frequency) non-normal acoustic performance can be achieved from a composition formed from at least one core layer and at least two septa, where the core layer is a material having a generally low-acoustic-impedance, a static shear modulus between about 1.0 psi (0.007 MPa) and about 15,000 psi (103 MPa), a transverse (or through-thickness) sound velocity for the acoustic waveform of between about 700 and about 2200 meters per second, a transverse (or through-thickness) acoustic impedance of less than or equal to $4\times10^6$ kilograms per square meter-second, and a shear loss factor of greater than 0.02 (and preferably greater than 0.1 shear loss factor), and the septa comprises at least one ply of a material which has a transverse acoustic impedance of less than $60\times10^6$ kg/m$^2$-sec, and preferably less than $10\times10^6$ kg/m$^2$-sec, a thickness of less than 0.10 $\lambda_M$, and is bonded to the core to form a sandwich with the core layer. $\lambda_M$ is the wavelength (meters) of the acoustic wave in the material and is calculated as the sound velocity at normal incidence (meters per second) of the material divided by the frequency (hertz) of the sound. In this instance, the material is the septa. The thickness of the window is measured similarly, except the weighted average sound velocity of the window is used and it is represented by $\lambda_W$. Ideally, the thickness of the composition or the window will be less than 1.0 $\lambda_W$, with less than 0.75 $\lambda_W$ being preferred.

The septa can be a material such as a plastic, a metal, or a composite material, with a carbon fiber reinforced epoxy composite being preferred. The septa have a tensile modulus of more than $0.5\times10^6$ psi to maintain the window shape under structural loading. In most designs, the septa with significantly higher tensile and compression moduli are necessary to meet structural requirements. By maintaining thin septa (preferably thinner than 0.05 $\lambda_M$), the generally uniform non-normal acoustic performance can be achieved over incidence angles of between −40° and +40°, where the angle of incidence is the angle between a plane which is the tangent to the window surface and a plane which is normal to the wave propagation vector. The preferred performance can be achieved over incidence angles of between −60° and +60°, with between −80° and +80° being further preferred. Acoustic windows of the present invention provide a waveform passage that can be utilized in a variety of acoustic window applications such as sonar domes and windows formed in vessel hulls.

DETAILED DESCRIPTION OF THE INVENTION

The present invention provides a window for the passage of acoustic waveforms. The window of the invention primarily is designed to have improved structural properties while preserving the acoustic properties of the window. The resulting window of the present invention can be designed for generally uniform insertion loss at a range of incidence angles and for acoustic tuning in a plurality of frequency ranges.

Figure 1:
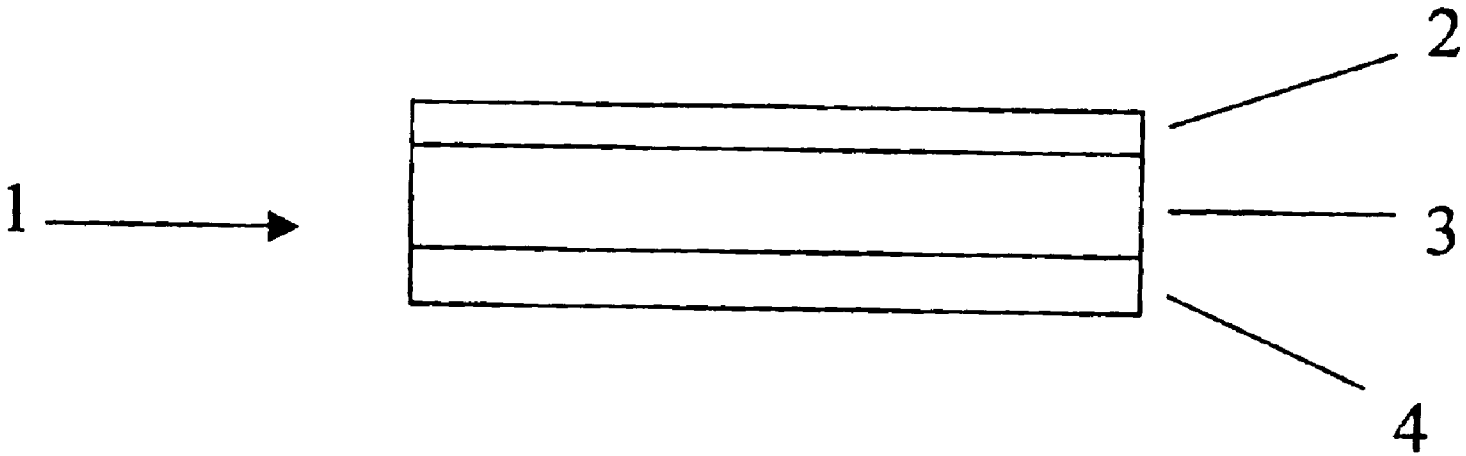
FIG. 1 is a cross-sectional view of an acoustic window in accordance with the present invention.

As is shown in FIG. 1, the acoustic window 1 consists of at least three layers, including at least two septa 2 and 4 and at least one core 3, but each septa is made using a material meeting the performance criteria and preferably is made using at least one ply of a carbon fiber/epoxy matrix composition. The window is configured to separate sound wave transmitting or receiving equipment from an open liquid such as seawater, through which it is desired sound signals be transmitted or received. Such domes can have any suitable or conventional shape such as generally ellipsoidal, hyperbolic, circular and the like. Alternatively, acoustic window can simply conform to a curvilinear portion of a vessel hull surface and thereby resemble in relatively flush appearance the installation of some windows in buildings and other land-based structures. The particular physical form taken by such a window in accordance with the invention will be, in part, a function of the particular acoustic waveform transmission/reception function to be provided by the acoustic waveform transmitter or receiver equipment positioned behind the window or within an enclosure at least partially defined by window.

The selection of the number of layers of a particular septa or core will be largely application dependent, with the primary consideration being the structural integrity required in the resulting window. FIG. 1 illustrates the preferred embodiment, in which a core layer is sandwiched by two septa layers, with optional coatings on each septum. A secondary consideration used in choosing the material is the properties of acoustic clarity and freedom from acoustic distortion and attenuation associated with the particular material employed. However, the choice of materials for septa and core is limited to generally "hard" or "rigid" materials that contrast with the relatively "soft" core materials, which results in a window capable of being designed for tuning in a plurality of frequency ranges. Design variation in the thickness of individual layers of window can be made to "tune" the window for use in another frequency range. Window can also be tuned for use in other frequency ranges by changing the materials comprising the layers of the window.

The septa preferably will be comprised of at least one ply of a material or materials that will provide the desired performance. The septa could be composed of metals, such as aluminum or titanium, plastics which provide high strength, or fiber composition materials. The material is preferably a carbon epoxy composition, but other fibers such as graphite can be used, and the compositions may be formed in suitable or conventional well known fashion. One technique is to form the composition by laying up prepregged carbon fabric. Another technique is to use a fiber-resin blend that has been impregnated with an epoxy binder. The plies of graphite/epoxy are laid up and cured under pressure in a known manner to form the septa layer. The core may be co-cured with the septa or bonded after the septa are cured. Another technique is a resin transfer molding or vacuum resin transfer molding process, in which dry fibrous performs are placed in a mold cavity or vacuum bag and then resin is transferred into the cavity by pressure or vacuum. Other fibers that could be used include glass fibers, ceramic fibers, carbon fibers, aramid fibers, polyester fibers, graphite fibers, mineral fibers, metal fibers, and combinations thereof. The resin binders that can be employed include thermosetting and thermoplastic polymers, such as epoxies, polyesters, vinyl esters, fluoropolymers, nylons, rubber toughened epoxies, or combinations thereof The septa for the window preferably have an ultimate strength of more than 1,000 pounds per square inch (psi), preferably more than 10,000 psi, and further, each preferably has a transverse sound velocity for the acoustic waveforms being transmitted of between about 1400 and about 3000 meters per second. In high-performance structural applications, the preferred septa material is a quasi-isotropic carbon fiber-reinforced epoxy prepreg laminate, which has a compression strength of about 70 ksi and a sound velocity of about 2650 m/s. It is desirable to minimize septum thickness by exploiting the orthotropic nature of the composition materials by changing fiber orientations to adjust the composition strength in different axes.

The core is formed of a material having a static shear modulus of between about 1.0 psi (0.007 MPa) and about 15,000 psi (103 MPa), and preferably the core has a transverse sound velocity, in a direction of the thickness of the core, for the acoustic waveforms being transmitted of between about 700 and about 2200 meters per second, preferably 1200 to 1800 m/sec. The core material is possessed of a shear loss factor of greater than 0.02 and the transverse velocity propagation characteristic for the acoustic wave form being transmitted through the window averages between about 1200 and about 2500 meters per second. Further, the core has a transverse acoustic impedance of less than $4\times10^6$ kg/m$^2$-sec.

It is preferred that the core be possessed of a transverse velocity propagation characteristic for the acoustic wave form being passed through the core closely approximate that of the liquid medium or lower in which the window is inmmersed. As an illustration, where the medium liquid is water, the transverse velocity propagation characteristic preferably is about 700 to 2200 m/sec.

Typically, the core is formed of a material such as a natural or synthetic rubber or other elastomer, and may be formed of castable, filled or unfilled materials. Synthetic rubbers suitable for use in the practice of the instant invention include styrene-butadiene and acrylonitrile based rubbers, the latter being commonly known in the industry as nitrile rubbers, butyl rubbers, and chlorinated rubbers such as Neoprene®. Other elastomers and polymers having utility in the practice of the invention include polyurethanes, polybutadienes, polyisoprenes, acrylic-copolymeric rubbers, EPDMS (ethylene propylene based polymers), polychloroprene, fluoropolymers, polyolefins such as polyethylene and polypropylene, polystryrene, high-impact polystryrene, and polymethyl pentene (or 4-methyl pentene-1), which is a linear, isotactic polyolefin sold by Goodfellow Cambridge Limited as TPX® polymer, has a density of 0.83 grams per cubic centimeter, and a specific gravity of about 0.84. By "rubber", what is meant is a vulcanized, or cross-linked rubber made according to suitable or conventional techniques. By "elastomer" what is meant is a material possessed of an ability to recover at least in part a former figure or shape upon removal of a figure or shape distorting force.

Castable polymers may be filled employing suitable or conventional materials. As an illustration, carbon black or glass fibers may be used as filler materials. Castable filled or unfilled synthetic polymers suitable for use in the practice of the instant invention include polyurethanes and so-called reactive liquid polymers like those available from Noveon, Inc. under the designations HYCAR®.

Since it is desirable to design a window to optimize multiple conflicting performance requirements (such as acoustic performance, structural performance, cost performance, durability, manufacturability, and consistency), the core is preferably a custom elastomer formulated for the specific application. The preferred core elastomer will minimize sound velocity, specific gravity, insertion loss, dynamic shear modulus, dilatational loss factor while maximizing shear loss factor, static shear modulus and durability. The rubbers and elastomers employed in the practice of the invention forming the core may include a filling agent. This filling agent, which may be present in a quantity of between zero and about 50 parts per hundred weight of elastomer or rubber and, generally is present in a quantity of between about 15 and 40 parts per hundred weight of elastomer or rubber. The filling agent may be a particulate such as carbon black, glass microspheres or microbeads or may be a fiber like additive such as mineral, polyester, polyolefin, polyaramid, cellulose, polyamides and polyvinyls such as polyvinyl alcohol (1 mm/6 denier). The use of KETJEN® commercially available carbon black in natural rubber at 40 parts carbon black per hundred parts natural rubber produces a core having a Young's modulus of 2400 psi. The use of 20 parts of KETJEN black per hundred weight of rubber in the same natural rubber while also employing 20 parts per hundred weight of 1 mm/6 denier polyvinyl alcohol per hundred weight of rubber produces a core material having a Young's modulus of between 8000 (55 MPa) and 12,000 (83 MPa) psi. While any suitable or conventional filler material for the rubbers or elastomers employed in forming the core can be employed, the selection of a particular filler material will be at least in part determined by the transverse velocity propagation characteristics for acoustic waveforms desired in any resulting core and by the desired modulus, static and Young's, it is desired be achieved in any resulting core.

The reinforcing material can be a material composed of reinforcing fibers, such as continuous or discontinuous fibers, which will be encapsulated in the matrix material. Reinforcing fibers may include glass fibers, carbon fibers, graphite fibers, mineral fibers, metallic fibers, quartz fibers, chopped fibers, ceramic fibers, silicon carbide fibers, stainless steel fibers, titanium fibers, nickel alloy fibers, polymeric fibers, aramid fibers, cellulose fibers, basalt fibers, alkaline resistant glass fibers and/or other fibers known to those knowledgeable in the arts. Reinforcing fibers may be in many forms, including yarns, tows, whiskers, continuous fibers, short fibers, woven fabrics, knitted fabrics, non-woven fabrics, random mats, felts, braided fabrics, wound tows, and/or other forms known to those knowledgeable in the arts.

The core and septa compositions may incorporate a wide variety of filler materials commonly used by those knowledgeable in the art. They may incorporate filler materials such as ceramic powders, mineral powders, silicon carbides, silicon nitrides, silicates, aluminum silicates, sodium aluminum silicates, potassium aluminum silicates, carbon, carbon black, organic fibers, inorganic fibers, polymeric fibers, carbon fibers, cellulose fibers, ceramic fibers, mineral fibers, waxes, oils, molybdenum and its compounds, or other fillers known to those knowledgeable in the arts. The filler materials also could be spheres such as microspheres, macrospheres, hollow and/or solid spheres, and/or cylindrical, flat and/or irregular or regular shaped particles.

The core and the septa can be bonded by techniques known in the art The particular technique is not critical and will depend upon the materials forming the core and the septa and their chemical natures. For example, the lamination can be accomplished by adhesive techniques or polymeric cross-linking techniques such as vulcanization or other chemical cross-linking. The surfaces can be joined uncured and then be cured together, as is preferred, or they can be preformed and then joined. It may be desirable to pre-treat the surfaces before bonding, such as by using a chlorinated solvent, xylene, benzene, or toluene, to activate the surface or facilitate bonding, or to use an appropriate adhesive composition such as epoxy adhesive, polyurethane adhesive, solvated rubber, solvated inorganic salts, acrylic adhesives, or the like, all of which are known in the art.

As can be appreciated, the present invention is useful as a cover or a barrier to protect ultrasonic or sonar equipment from the environment and is especially useful when the environment is, for example, seawater. It can be shaped into curved or dome shapes during the bonding step, as is conventional in the art, or it can be used as a planar window. So, the window can be used in ocean or oil exploration to protect ultrasonic or sonar equipment, in flaw detection apparatus used in non-destructive testing, and the like.

The septa and core together, that is, the sandwich, will define a thickness which preferably is less than 1.0 $\lambda_W$, with less than 0.75 $\lambda_W$ being further preferred. The wavelength or $\lambda$ (meters) of a material at a given frequency is the length of an acoustic wave traveling through the material at normal incidence, and is calculated as the sound velocity at normal incidence of the material or the weighted average sound velocity of the window (meters per second) divided by the frequency (hertz) of the sound. Each septum will have a thickness of less than 0.1 $\lambda_M$, preferably less than 0.05 $\lambda_M$.

The acoustic composition in accordance with the present invention has exceptional and unexpected acoustic performance, including the following:

Low insertion loss over a wide range of frequency and angles;

Exceptionally high strength vs. Insertion Loss Ratio over a wide range of frequency and angles; and Exceptionally high stiffness vs. Insertion Loss Ratio over a wide range of frequency and angles.

The configuration of the window can be varied in that there can be more than one core. Typically, the window will comprise a single core to which is adhered, using an adhesive layer on either side of the core, septa comprised of at least one layer of carbon epoxy. Other configurations, could be a two core structure in which two cores are bonded to a ply or plies of graphite epoxy using adhesive layers and that structure, in turn, is bonded to septa to form multilayer designs. A rubber layer may be applied to the external surface of the window without significantly degrading insertion loss.

An acoustic window was made by assembling carbon/epoxy skins or septa over an elastomeric core. Eight plies of uncured carbon/epoxy prepreg were applied to a curved mold plate, to form a ⅛-inch thick septum. Five plies of uncured rubber forming a ½-inch thick core were applied over the uncured septum. Next, an additional eight plies of uncured carbon/epoxy were applied over the core to form the final ⅛-inch thick septum. Further, a solid carbon/epoxy edge-band was employed around the outer edges of the window. Then, two fiberglass prepreg plies were applied to the inboard surface of the edge band for galvanic insulation. The assembly then was vacuum bagged and autoclave cured at 270° F. and 90 psi pressure. The window was trimmed, bolt holes were drilled, coated metallic sleeves were bonded in each bolt hole to further protect the bolts from galvanic corrosion, and the exposed carbon fibers were sealed with filled epoxy resin for galvanic insulation. Finally, the window was primed and painted with ultraviolet resistant polyurethane paint to produce a finished window.

The carbon/epoxy lamina material properties were as follows:

Specific Gravity: 1.6

Sound Velocity (through-thickness): 2644 m/s

Sound Velocity (in-plane): Unknown

In-Plane Young's (XX) Modulus:8 Msi (74.5 GPa)

Through-thickness Tensile (ZZ) Modulus: (estimated to be 1.0 Msi (6.9 GPa))

In-Plane (XY) shear Modulus: 0.75 Msi (5.2 GPa)

Through-thickness (XZ and YZ)

Shear Modulus: 0.79 Msi (5.4 Gpa)

Shear Loss Tangent: (estimated to be 0.01)

Dilatational Loss Tangent: (assumed to be zero)

Ply orientation: Quasi-isotropic

The core elastomer properties were as follows:

10° C. Properties

Specific Gravity: 1.104

Sound Velocity: 1650 m/s

Dynamic Shear Modulus: $6\times10^7$ Pa

Shear Loss Tangent: 0.15

Dilatational Loss Tangent: 0.02

Static Shear Modulus: $1.1\times10^7$ Pa (~1600 psi)

20° C. Properties

Specific Gravity: 1.104

Sound Velocity: 1600 m/s

Dynamic Shear Modulus: $5\times10^7$ Pa

Shear Loss Tangent: 0.15

Dilatational Loss Tangent: 0.03

Static Shear Modulus: $1.1\times10^7$ Pa (~1600 psi)

Figure 2:
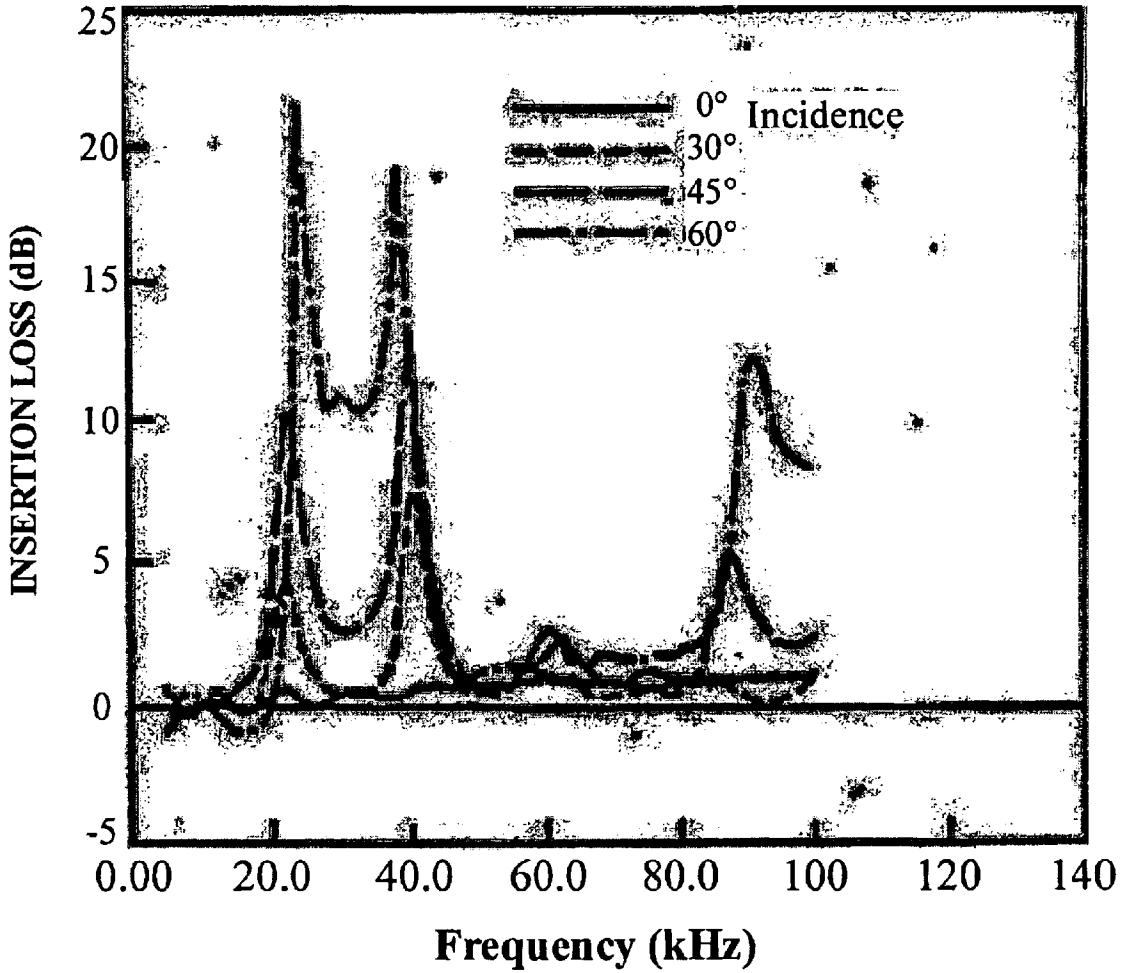
FIG. 2 is a graphical representation comparing the insertion loss at various incidence angles versus frequency of a rigid composition plate having a near-perfect impedance match with water.

FIG. 2 illustrates the typical insertion loss pattern of a rigid material (i.e. Poisson's ratio less than 0.45), in which Insertion Loss spikes appear at discrete angles of incidence, even with a near-perfect water impedance match. FIG. 2, which has been taken from Dubbleday, IEEE Journal of Oceanic Engineering Vol. OE-12, No. 2, FIG. 6, April, 1987, in an article entitled "Shear Modulus Effect on Acoustically Transparent Materials", is a plot of insertion loss versus frequency and shows that there are tremendous differences between acoustic performance at normal incident angles and non-normal incident angles. Conventional wisdom suggested that a window with a perfect impedance match with the surrounding water would have near zero insertion loss. FIG. 2 graphically shows he insertion loss of a 40 cm×40 cm×1.9 cm fluoroepoxy composition panel at 22° C. temperature and 345 kPa pressure, as a function of frequency at various angles of incidence. The acoustic medium is freshwater, and the window has a nearly perfect impedence match (sound velocity match is within 0.1% and the density match is within 3.4%) within the surrounding water. The expected insertion loss is very low (i.e., less than 1.0 db) at normal incidence across a wide frequency range. However, at non-normal incidence angles severe insertion, severe insertion loss spikes appear (i.e., sharp changes in insertion loss over a generally narrow range of angle). Since a monolithic window, with near-perfect impedance match, has severe insertion loss spikes, designing a window for uniform insertion loss performance across a wide range of non-normal incidence angles, it is far more complex to designing a window for normal incidence performance.

Figure 3:
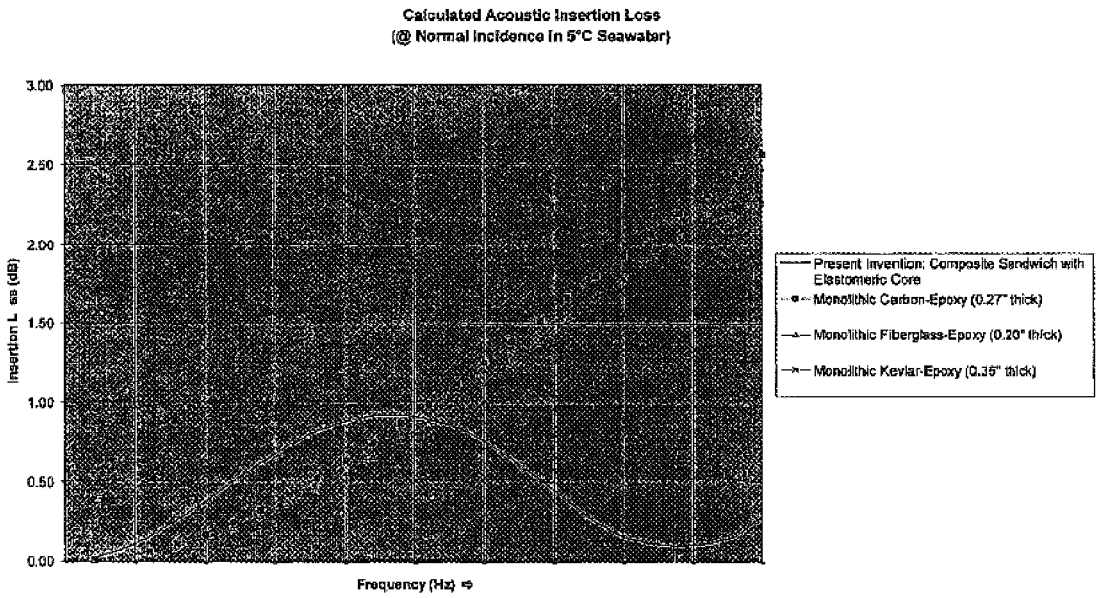
FIG. 3 is a graphical representation comparing the calculated insertion loss, at normal incidence in 5° C. seawater, as a function of frequency for acoustic windows made in accordance with the present invention, and comparing them with various laminates.

FIG. 3 shows the calculated insertion loss at normal incidence in 5° C. seawater for a variety of monoliths as compared to the present invention.

Figure 4:
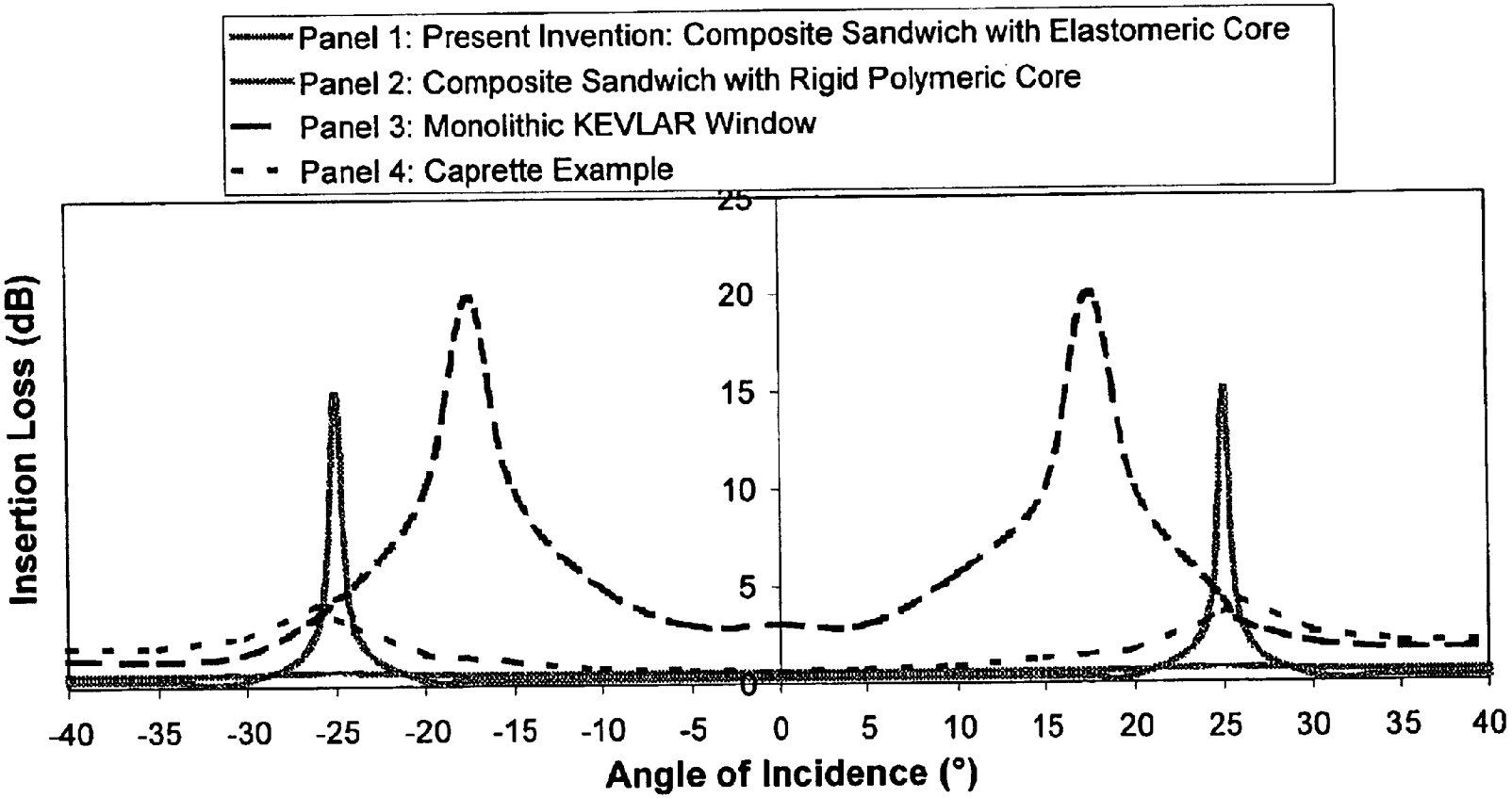
FIG. 4 is a graphical representation comparing typical insertion loss as a function of the angle of incidence of acoustic windows made in accordance with the present invention and prior art composition materials.

FIG. 4 graphically represents the dramatic Insertion Loss benefits of a sandwich configuration in accordance with the present invention compared to prior art materials at higher frequencies. Further, the configuration of the present invention can be tuned to optimize performance at specific frequency ranges by varying the composition of the core and/or the thickness of the core.

Panel 1 is a composite sandwich in accordance with the present invention

Panel 2 is a composite sandwich with a "Rigid" Polymeric Core Material

Panel 3 is a monolithic window made from Kevlar® fibers and an epoxy binder.

Panel 4 is a window representative of the disclosure of Caprette (U.S. Pat. No. 4,997,705).

The insertion loss of Panel 1 is essentially uniform between −40° and +40° within the 1 dB resolution of the measurements and the plots. However, all other panels have a severe insertion loss spikes at discreet angles. Both Panel 1 and Panel 2 have 0.11-inch thick carbon/epoxy septa. The core materials of Panels 1 and 2 have similar acoustic impedance and thickness. The Panel 2 IL spike is attributed to the primary differences between Panel 1 and Panel 2, which are the core shear modulus and the core shear loss factor. The elastomeric core of the present invention in Panel 1 has a static shear modulus of approximately 1600 psi and a shear loss factor of 0.15. The polymeric core in Panel 2 has a high impact polystyrene core, a static shear modulus of approximately 50,000 psi, and a loss factor of 0.01. The Panel 3 IL spike is attributed to the thick structural layer and the rigid shear properties since it is a monolithic aramid fiber/epoxy composition being about 0.75 inch thick and has an interlaminar shear modulus of approximately 500,000 psi and a shear loss factor of about 0.01. Since Panel 4 has a soft core (static shear modulus 1200 psi) with a high shear loss factor (approximately 0.2), the Panel, the Panel 4 IL spike is attributed to the thick septa. Panel 4 is a composition having a natural rubber core and with two 0.25-inch thick fiberglass septa formed from glass fabric pre-pregged with epoxy, in accordance with Example 1 of Caprette.

The acoustic literature (Dubbleday, noted earlier) indicates a relationship between window thickness and the threshold frequency at which Insertion Loss (IL) spikes appear. However, it was surprising when empirical testing of composition sandwich panels empirically suggested that this threshold frequency was nearly independent of core thickness, if the core was a soft elastomer.

To understand the value of the present invention, reference can be had to FIG. 4 of the Caprette et al U.S. Pat. No. 4,997,705, which is explained as follows in Column 8, lines 49–59:

"The performance indicated by the curve 28 displays a regional minimum signal reduction at a half-wave frequency 30 and a regional maximum signal reduction at a quarter-wave frequency 32."

It is useful to discuss this curve in terms of wavelenghts ($\lambda_W$) because the curve shape suggests wave phase cancellation and addition. Of course, detailed performance prediction requires sophisticated analytical tools using the basic wave equations, which predict a resonance null near 0.5 $\lambda_W$ and a resonance peak near 0.75 $\lambda_W$. The window thickness, particularly the core thickness is a key tuning variable to minimize insertion loss at key frequencies near normal incidence angles.

A panel simulating the Caprette example shows IL spikes (above 3 dB) at discreet incidence angles when the septum wavelength (which is inversely proportional to frequency) is significantly below the threshold septum acoustic wavelength of 5.6 inches. At this threshold, the ratio between septum thickness (t) and wavelength ($\lambda$) is 0.25/5.6=0.044. As the frequency increases, the IL spikes become more and more noticeable and increasingly undesirable. Since high performance acoustic windows operate across a wide range of incidence angles, non-normal acoustic performance can be critical in high-performance sonar systems. Although Caprette does not teach how to achieve angular uniformity, some rubber windows, fiberglass/elastomer/fiberglass sandwich windows and aramid composition/elastomer/aramid composition sandwich windows can have good angular uniformity at lower frequencies. Caprette does not teach that the septum thickness becomes critical to achieve angular uniformity as structural requirements and/or frequencies increase. Although Caprette discloses carbon compositions can be used as septum material, Caprette does not teach what is necessary to achieve angular uniformity. The present invention is the result of the discovery that carbon compositions properties (such as high compression strength, high compression stiffness and low impedance) enable thin-walled septa ideal for uniform non-normal waveform transmission. The reason the carbon/epoxy laminates are the preferred septum material is illustrated in the following example:

Assume a cylindrical window designed to withstand 200 kPa external pressure (P) with a safety factor (SF) of 4.0. If the Radius of curvature (R) is 1 meter, the compression stress ($\sigma_c$) is calculated by the following equation:

$$\sigma_c = P*R/t, \text{ (where } t \text{ is the thickness of the window)}$$

In this example, the material compression strength (C) drives the minimum allowable design thickness, as shown in the following equation:

$$t_{minimum} = P*R*(SF)/C$$

In a preferred embodiment, the carbon/epoxy composition has a compression strength of approximately 600 MPa, whereas alternative materials have much lower compression strengths (see Table 1).

Structurally, the carbon/epoxy material allows thinner septa and superior angular uniformity. It should be noted that the next strongest material, fiberglass/epoxy, is an economical alternative that is somewhat penalized by its high acoustic impedance.

TABLE 1

Example: Minimum Thickness for Cylindrical Window Example

| Material | Acoustic Impedance ($kg/m^2 - s$) | Compression Strength Allowable (MPa) | Minimum Allowable Thickness (mm) |
|---|---|---|---|
| Carbon/epoxy | $4.2 \times 10^6$ | 600 | 1.2 |
| Fiberglass/epoxy | $5.4 \times 10^6$ | 300 | 2.4 |
| Aramid/Epoxy | $3.5 \times 10^6$ | 150 | 4.8 |
| Polyethylene/epoxy | $1.7 \times 10^6$ | 60 | 12.0 |

As discussed and illustrated in FIGS. 2 and 4, the septum thickness, the core shear loss factor and the core shear modulus are critical mechanisms for achieving angular IL uniformity and reducing the amplitude of the insertion loss spikes or "horns". The shear loss factor is defined as the ratio of the viscous component (G") over the elastic component (G') of the dynamic (or complex) shear modulus.

Acoustic analysis indicates that increasing the shear loss factor dramatically reduces the amplitude of the transmission loss horns. In the preferred configuration, changing the shear loss factor from 0.02 to 0.15 reduced the peak transmission loss horn amplitude from 20 dB to 1 dB. Since fiberglass compositions typically have very low shear loss factors (typical shear LF<0.02), the fiberglass core configurations envisioned by Hauser, and represented by Panel 2 in FIG. 4, will tend to have high transmission loss horns, especially at high frequencies.

It should be noted that the ideal core material considers both shear loss factor and dilatational loss factor, because a high dilatational loss factor increases transmission loss and is thus undesirable. The dilatational loss factor is defined as the ratio of the viscous component (B") over the elastic component (B') of the dynamic (or complex) Bulk modulus.

Figure 5:
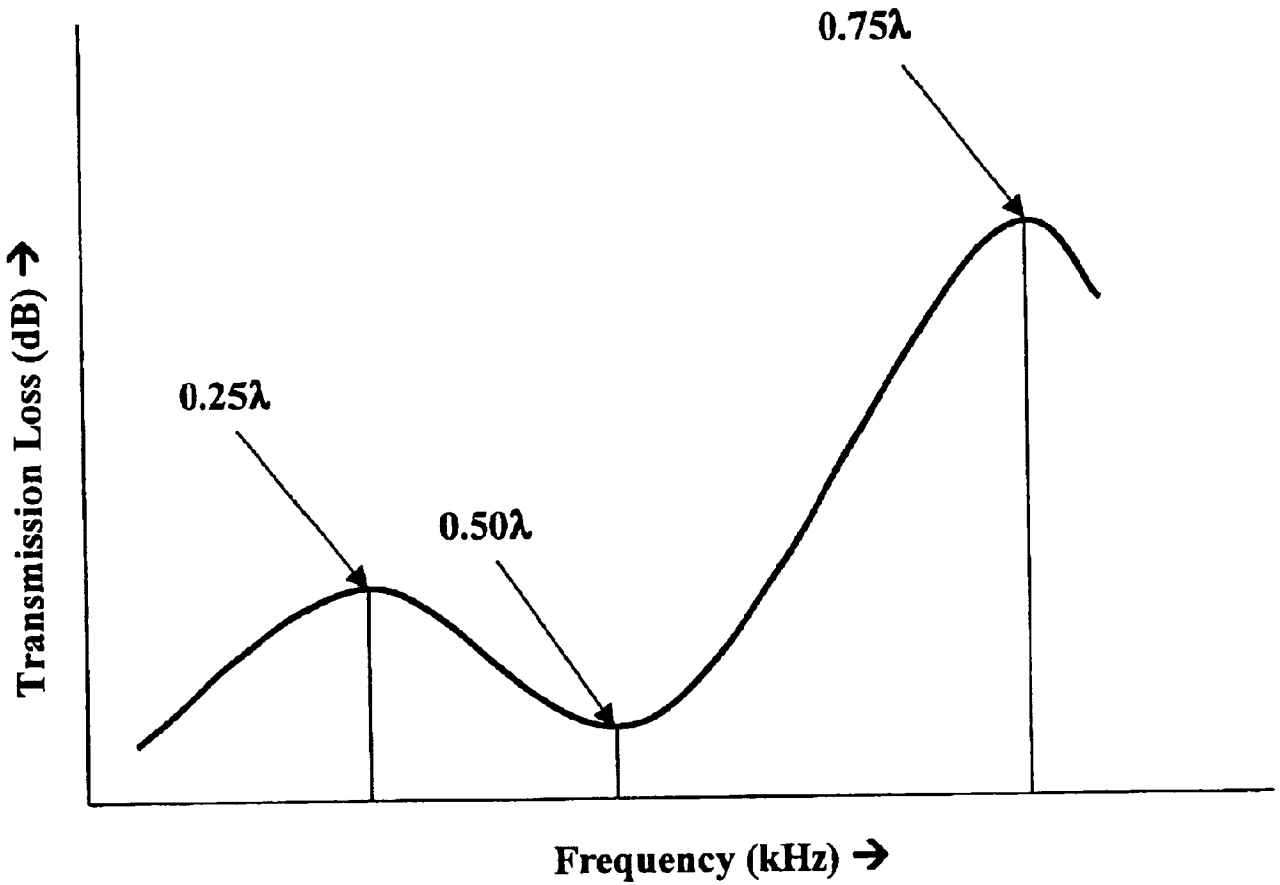
FIG. 5 is a graphical representation of transmission loss or attenuation of an acoustic wave form signal as a function of frequency.

To minimize insertion loss at normal incidences, the preferred thickness of the composite window will be less than 0.75 $\lambda_W$ to avoid the second resonance peak shown in FIG. 5. In some the applications, however, normal incidence performance is much less important than performance at non-normal incidence because of the insertion loss spikes shown in FIG. 2 and FIG. 4. The inventor envisions applications in which a very thick core elastomer is sandwiched by thin septa. If the elastomeric core is sufficiently transparent and the septa are sufficiently thin, windows thickness is not critical and an effective window may exceed 1.0 $\lambda_W$ in thickness Thicker cores tend to increase cost, stiffness and damping, so the optimum thickness depends on the specific application.

Acoustic analysis indicates that decreasing the shear modulus dramatically reduces the amplitude of the transmission loss horns. In the preferred configuration, changing the dynamic shear modulus from 350 MPA to 50 MPa reduced the peak transmission loss horn amplitude from 20 dB to 1 dB. It should be noted that rigid materials (i.e. materials with high static shear moduli) generally have low shear loss factors compared to elastomeric materials.

Experimental data surprisingly indicates that significant changes in core thickness have a relatively small effect on the transmission loss horn amplitude. In contrast, the septum thickness (not the core thickness) appears to be a critical factor determining the amplitude of the transmission loss horns.

Since rigid layers (that is layers with a high shear moduli and/or low shear loss factors) are typically necessary to meet structural requirements, the examples in FIGS. 2 and 4 help isolate the factors necessary to incorporate a rigid material into the window without inducing IL spikes. The Hauser type sandwich with a rigid core (Panel 2), the Caprette example with thick septa (Panel 4), the rigid kevlar/epoxy panel (Panel 3) and the rigid Dubbelday panel (FIG. 2) share a common feature: a relatively thick layer that is rigid. It is hypothesized that IL spikes are caused by shear resonances within rigid materials. At a given frequency, sharp shear resonance manifested as IL spikes appear when the material thickness exceeds a threshold value. So, it is critical to ensure that no rigid layer exceeds that threshold value for angular IL uniformity. Because Panel 2 (similar to Hauser) has a rigid core bonded to rigid septa, it appears that the combined sandwich thickness (that is core plus both septa) must remain below the IL threshold value to maintain angular uniformity. In other words, if the septa are strongly coupled in shear (that is the core has a high shear modulus), the sandwich thickness (including the core thickness) is the critical factor determining the amplitude of the transmission loss horns. It is useful to discuss the strongly coupled sandwich as a thick resonating rigid body that tends to exhibit the high transmission loss peaks illustrated in FIG. 4, especially at high frequencies. Since fiberglass composites typically have very high shear moduli (typical shear modulus >2000 MPa), the fiberglass core configurations envisioned by Hauser will tend to have high transmission loss horns.

However, it has been discovered that angular uniformity can be maintained by using a soft core material to separate multiple thin rigid layers. Unlike Hauser, the present invention maintains IL uniformity if the combined septa thickness (as opposed to the entire window thickness) remains below the IL threshold value. It appears that the Panel 4 of FIG. 4 supports the hypothesis that the core shear loss factor significantly damps the amplitude of the IL spikes. To minimize transmission loss horn amplitude, each septum thickness ideally should be less than 0.05 $\lambda_M$, where $\lambda_M$, is the Material Wavelength (meters), which equals the septum material sound velocity at normal incidence (meters per second) divided by the Frequency (Hertz)$\rightarrow\lambda=c/f$. If this is not practical, the thickness of each septum should be minimized. Empirical data suggests significant transmission loss horn amplitude if the septum thickness exceeds 0.10 $\lambda_M$.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. An improved acoustic window for an acoustic waveform passage having a generally uniform transmission loss at an angle of incidence of between −40° and +40° comprising a laminate composition formed from at least one core layer and at least two septa, said core layer comprising a material having a generally low-acoustic-impedance, a static shear modulus between about 1.0 psi (0.07 MPa) and about 15,000 psi (103 MPa), an average transverse (or through-thickness) sound velocity for the acoustic waveform of between about 700 and about 2200 meters per second, a transverse acoustic impedance of less than or equal to $4\times10^6$ kilograms per square meter-second, and a shear loss factor of greater than 0.02, each of said septa being composed of at least one ply of a material having a transverse acoustic impedance of less than $60\times10^6$ kg/m$^2$-sec, a thickness of less than 0.10 $\lambda_M$ wherein $\lambda_m$ is the wavelength of an acoustic wave in the material, a tensile modulus of more than $0.5\times10^6$ psi, and being bonded to said core to form a sandwich with said core layer, and the acoustic waveform having a $\lambda$ of at least 0.001 meter and less than 3 meters.

2. The acoustic window of claim 1 wherein said core layer comprises a composition selected from the group consisting of polyurethane, neoprene, nitrile rubber, EPDM, butyl rubber, natural rubber, synthetic rubber, polyisoprene, polystryene-butadiene, polybutadiene, polychloroprene, high impact polystyrene, copolymers of polystyrene, fluoropolymer, polyolefin, polyetheretherketone, and blends thereof.

3. The acoustic window of claim 1 wherein each septa is composed of at least one ply of a metal, a plastic, a fiber reinforced composite, or combinations thereof.

4. The acoustic window of claim 3 wherein the septa is a metal selected from the group consisting of aluminum, titanium, and combinations thereof.

5. The acoustic window of claim 1 wherein each septa is composed of at least one ply of a fiber reinforced composite.

6. The acoustic window of claim 5 wherein the fiber in said fiber reinforced composition is selected from the group consisting of glass fibers, ceramic fibers, carbon fibers, aramid fibers, graphite fibers, mineral fibers, metal fibers, and combinations thereof.

7. The acoustic window of claim 5 where in the fiber reinforced composition employs as the binder a thermosetting or thermoplastic polymer.

8. The acoustic window of claim 5 where in the fiber reinforced composition employs as the binder a thermosetting or thermoplastic polymer selected from the group consisting epoxies, polyesters, vinyl esters, fluoropolymers, nylons, or rubber toughened epoxies, or combinations thereof.

9. The acoustic window of claim 5 wherein said fiber reinforced composition is a fiber reinforced epoxy composition.

10. The acoustic window of claim 1 wherein the average transverse sound velocity is between about 1400 and 2200 meters per second.

11. The acoustic window of claim 1, wherein the window has an average sound velocity of about 1800 to 2100 meters per second.

12. The acoustic window of claim 1 wherein the core has a static shear modulus of between about 100 and 2000 psi.

13. The acoustic window of claim 1 wherein each septa has a thickness of less than 0.05 $\lambda_M$, wherein $\lambda_M$ is the wavelength of an acoustic wave in the window.

14. The acoustic window of claim 1 wherein the window has a thickness of less than 1.0 $\lambda_w$ wherein $\lambda_w$ is the wavelength of an acoustic wave in the window.

15. The acoustic window of claim 1 wherein the window has a thickness of less than 0.75 $\lambda_w$ wherein $\lambda_w$ is the wavelength of an acoustic wave in the window.

16. The acoustic window of claim 1, wherein the window has generally uniform transmission loss an angle of incidence of between −60° and +60°.

17. The acoustic window of claim 1, wherein the window has generally uniform transmission loss an angle of incidence of between −80° and +800.

18. The acoustic window of claim 1, wherein the septa has a tensile and/or compression strength of more than 25,000 psi.

19. The acoustic window of claim 1, wherein the septa has a tensile and/or compression strength of more than 70,000 psi.

20. The acoustic window of claim 1 wherein the core layer has a Poisson's ratio of more than 0.45.

21. The acoustic window of claim 1 wherein the core layer has a Poisson's ratio of more than 0.49.

22. The acoustic window of claim 1 wherein the core layer and/or the septa employ fibers and/or microspheres.

23. The acoustic window of claim 1, wherein the window has specific gravity in the range of 1.0 to 1.4.

24. The acoustic window of claim 1 wherein the window has SpGr in the range of 1.1 to 1.3.

25. The acoustic window of claim 1, wherein the window has a structural factor of greater than 1.

26. The acoustic window of claim 1 wherein the window has a structural factor of greater than 2.

27. The acoustic window of claim 1, wherein the core has acoustic impedance of less than $2\times10^6$ kg/m$^2$-s.

28. The acoustic window of claim 1, wherein the septa has an acoustic impedance of less than $10\times10^6$ kg/m$^2$-s.

29. The acoustic window of claim 1, wherein the septa has an acoustic impedance of less than $5\times10^6$ kg/m$^2$-s.

30. The acoustic window of claim 1, wherein the septa are bonded to the core using an adhesive layer.

31. The acoustic window of claim 1, wherein the window has at least two cores bonded together, and having at least one septum ply in between the cores.

32. The acoustic window of claim 1 having at least seven core layers bonded together and having at least one septum ply in between each core layer.

33. The acoustic window of claim 1, wherein the septa have a flexural stiffness of more than $2.5\times10^6$ psi.

34. The acoustic window of claim 1, wherein the septa have a flexural stiffness of more than $4.0\times10^6$ psi.

35. The acoustic window of claim 1, wherein the laminate includes an additional galvanic insulation layer for placement between the laminate and any metallic surface to which the laminate is attached.

36. The acoustic window of claim 1, wherein the septa and/or core have an acoustic impedance matching seawater within ±10%.

37. The acoustic window of claim 1, wherein the edges of the laminate are encapsulated with a structural edge band material.

38. The acoustic window of claim 1, wherein the window is formed as a curved or dome shaped structure.

39. The acoustic window of claim 1 which further includes means for mounting said window.

40. The acoustic window of claim 1, wherein the septa has acoustic impedance of less than $2.0\times10^6$ kg/m$^2$-s.

41. The acoustic window of claim 1 wherein the laminate includes an additional galvanic insulation layer selected from the group consisting of glass fiber composition, glass bead compositions, polymeric compositions, elastomeric compositions, polyurethane compositions, rubber compositions, epoxy compositions, acrylic compositions, and combinations thereof.

42. The acoustic window of claim 1 which further includes a coating selected from the group consisting of primers, paints, polymeric, elastomeric, acoustic damping, cosmetic, camouflage, electromagnetic, ultraviolet resistant, fouling resistant, color, impact resistant, and combinations thereof.

43. The acoustic window of claim 1 wherein the septa have a tensile modulus and/or a compression modulus of more than $7\times10^6$ psi.

44. The acoustic window of claim 1 wherein the septa have a tensile modulus and/or a compression modulus of more than $10\times10^6$ psi.

45. The acoustic window of claim 1 wherein the core layer and/or the septa further employ fibers selected from the group consisting of thermoplastic, polyethylene, polyvinyl alcohol, mineral, carbon, graphite, cellulose, aramid, polybenzoxazole, metal, and combinations thereof.

46. The acoustic window of claim 1 wherein the core has a shear loss factor of 0.1 or higher.

47. The acoustic window of claim 1 wherein the core has a core sound velocity of about 1200 to 1800 meters per second.

* * * * *